US005521675A

United States Patent [19]

Poplawski et al.

[11] Patent Number: 5,521,675

[45] Date of Patent: May 28, 1996

[54] ANNOTATION SYSTEM OCCLUDING DEVICE FOR AN ELECTROPHOTOGRAPHIC PRINTING APPARATUS

[75] Inventors: Leon G. Poplawski, Webster; John S. Serafin, Jr., Honeoye Falls; Daniel J. McTigue, Fairport, all of N.Y.

[73] Assignee: Xerox Corporation, Stamford, Conn.

[21] Appl. No.: 496,067

[22] Filed: Jun. 28, 1995

[51] Int. Cl.[6] ..... G03G 15/36

[52] U.S. Cl. ..... 355/202; 355/39

[58] Field of Search ..... 355/202, 218, 355/41, 39

[56] References Cited

U.S. PATENT DOCUMENTS

| | | | |
|---|---|---|---|
| 3,827,799 | 8/1974 | Koizumi | 355/218 |
| 4,712,907 | 12/1987 | Weinberger et al. | 355/218 |
| 4,806,976 | 2/1989 | Kato et al. | 355/202 |
| 5,021,832 | 6/1991 | Fukushima | 355/218 |
| 5,268,716 | 12/1993 | Ito | 355/202 |

*Primary Examiner*—Joan H. Pendegrass
*Assistant Examiner*—Sophia S. Chen
*Attorney, Agent, or Firm*—Denis A. Robitaille

[57] ABSTRACT

An annotation system for automatically recording additional image information on an image bearing member such as a photoconductive member in an electrostatographic printing machine. The annotation system includes an occluding device assembly having an occluder bar for masking the image bearing member in a predetermined region to allow for the additional image information to be recorded thereon and a drive apparatus for selectively positioning the occluder bar with respect to an image area on the image bearing member, wherein a system is provided for releasably mounting the occluder bar to the drive apparatus. The system also includes a light emitting source for producing a light image of the additional image information on the masked region of the image bearing member.

18 Claims, 4 Drawing Sheets

ANNOTATION SYSTEM OCCLUDING DEVICE FOR AN ELECTROPHOTOGRAPHIC PRINTING APPARATUS

The present invention relates generally to an electrophotographic printing machine, and more specifically concerns a device for masking a region of a photoconductive member in an electrophotographic printing machine to prevent discharge thereof such that the masked region can be selectively discharged in a separate annotation process for recording a latent image corresponding to additional indicia.

Generally, the process of electrophotographic printing is initiated by charging a photoconductive member to a substantially uniform level. Thereafter, the charged portion of the photoconductive member is exposed to a light image of an original document being reproduced. Exposure of the charged photoconductive member selectively dissipates the charge thereon in the irradiated areas. This process records an electrostatic latent image on the photoconductive member corresponding to the informational areas contained within the original document. After the electrostatic latent image is recorded on the photoconductive member, a developer material is brought into contact with the latent image to produce a visible developed image. Generally, the developer material is made up of toner particles adhering triboelectrically to carrier granules. The toner particles developed image is formed by attracting away from the carrier granules and over to the latent image on the photoconductive member. Thereafter, the toner particles making up the developed image are transferred from the photoconductive member to a copy substrate such as a sheet of paper. Heat or some other treatment is applied to the toner particles on the copy substrate to permanently affix the powder image to the copy substrate. In a final step in the process, the photoconductive member is cleaned to remove any residual developing material on the photoreceptive surface thereof in preparation for successive imaging cycles.

The electrophotographic printing process described above is well known and is commonly used for light lens copying of an original document. Analogous processes also exist in other electrostatographic printing applications such as, for example, digital printing where the latent image is produced by a modulated laser beam, or ionographic printing and reproduction, where charge is deposited on a charge retentive surface in response to electronically generated or stored images.

Over the years, numerous and various efforts have been made to improve and enhance the customer features found in high speed electrophotographic printing machines. Among these efforts, there has been an attempt to provide a reliable system for automatically annotating or serially marking the documents produced in the electrophotographic process, such as pagination of output sheets and the like. Such efforts have generally been directed toward a system which prevents the discharging of a selected local area in the image area on the photoreceptor corresponding to each document, and thereafter discharging a portion of the selected local area via a light pattern in the form of one of a sequence of alphanumeric characters. The following disclosures may be relevant to various aspects of the present invention:

U.S. Pat. No. 4,712,907

Patentee: Weinberger et al.

Issued: Dec. 15, 1987

U.S. Pat. No. 4,806,976

Patentee: Kato et al.

Issued: Feb. 21, 1989

U.S. Pat. No. 5,021,832

Patentee: Fukushima

Issued: Jun. 4, 1991

The relevant portions of the foregoing disclosures may be briefly summarized as follows:

U.S. Pat. No. 4,712,907 discloses an electrophotographic printing machine for reproducing an original document with a copy thereof having additional indicia thereon. A means such as a movable "occluder bar" is used to mask a region of photoconductive member from the illuminating means to prevent discharge at that region. Then a means to discharge selectively the masked region records a latent image corresponding to the additional indicia.

U.S. Pat. No. 4,806,976 discloses a copying apparatus having the capability to write optional pattern information on a copy sheet. The apparatus comprises an original glass plate, a photosensitive drum, plural devices for forming a copied image of the original document on the photosensitive drum, an editor for inputting arbitrary coordinate data, an eraser including an LED array, a control circuit for controlling the eraser in accordance with input date, and a transfer device for transferring the copied image and the pattern image on the same surface of a copy sheet.

U.S. Pat. No. 5,021,832 discloses an electrophotographic copier comprising an optical system for projecting an original image onto a photoreceptor to form an electronic latent image thereon, and a movable LED array for forming an electrostatic latent image corresponding to additional information on the photoreceptor. A seal is applied to a bottom face of an original supporting glass table for retaining electric charge on a selected region of the photoreceptor by partially intercepting the original image projected by the optical system. The LED array is switchable between a mode for recording the additional information on the selected region of the photoreceptor, and a mode for erasing the charge in the selected region.

In commonly assigned U.S. Pat. No. 4,712,907, identified hereinabove, and incorporated herein by reference, the occluder bar protrudes substantially perpendicularly from a drive assembly which permits variable positioning of the occluder bar relative to the top or bottom margin of the copy sheet. This drive assembly is mounted within the copy machine and may be fixed to other machine subsystems which may require the removal of the occluder bar assembly with the other machine subsystem when servicing that other subsystem. Since the occluder bar protrudes outwardly, the occluder bar often becomes damaged or misaligned due to mishandling and inadvertent collisions with fixed structures during handling by service technicians and the like. Therefore, it is desirable to provide a releasable or removable occluder bar assembly that allows for ease in replacement of the occluder bar in the situation where the occluder bar may become damaged or misaligned.

In accordance with the present invention, there is provided an annotation system for automatically recording additional image information on an image bearing member, comprising: an occluding device assembly, including an occluder bar for masking the image bearing member in a predetermined region to allow for the additional image information to be recorded thereon; a drive apparatus for selectively positioning the occluder bar with respect to an image area on the image bearing member; means for releasably mounting the occluder bar to the drive apparatus; and a light emitting source for producing a light image of the additional image information.

Pursuant to another aspect of the present invention, there is provided an electrostatographic printing machine for reproducing a copy of an original document, the copy including additional image information thereon, comprising: a photoconductive member; means for charging at least a portion of the photoconductive member to a substantially uniform potential; means for selectively illuminating the charged portion of the photoconductive member to selectively discharge the charged portion of the photoconductive member such that an electrostatic latent image corresponding substantially to the original document being reproduced is recorded thereon; and an annotation system for automatically recording additional image information on the photoconductive member, including an occluder bar for masking a region of the charged portion of the photoconductive member normally discharged by the illuminating means to prevent the discharge thereof by the illuminating means; a drive apparatus for selectively positioning the occluder bar with respect to an image area on the image bearing member; means for releasably mounting the occluder bar to the drive apparatus; and means for selectively discharging the masked region of the charged portion of the photoconductive member to record an electrostatic latent image thereon corresponding to the additional image information.

Other aspects of the present invention will become apparent as the following description proceeds and upon reference to the drawings, in which.

Figure 3:
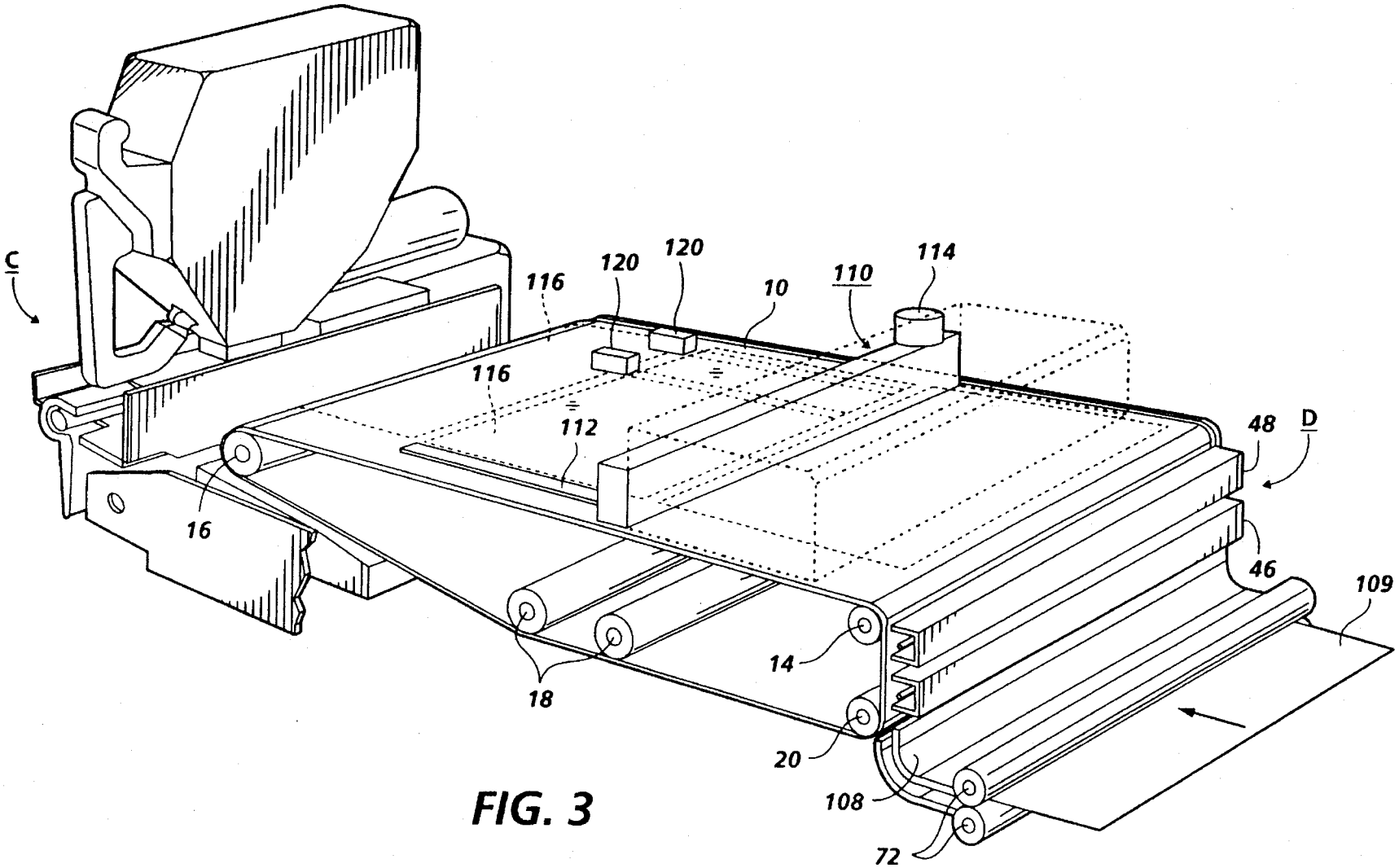
Figure 4:
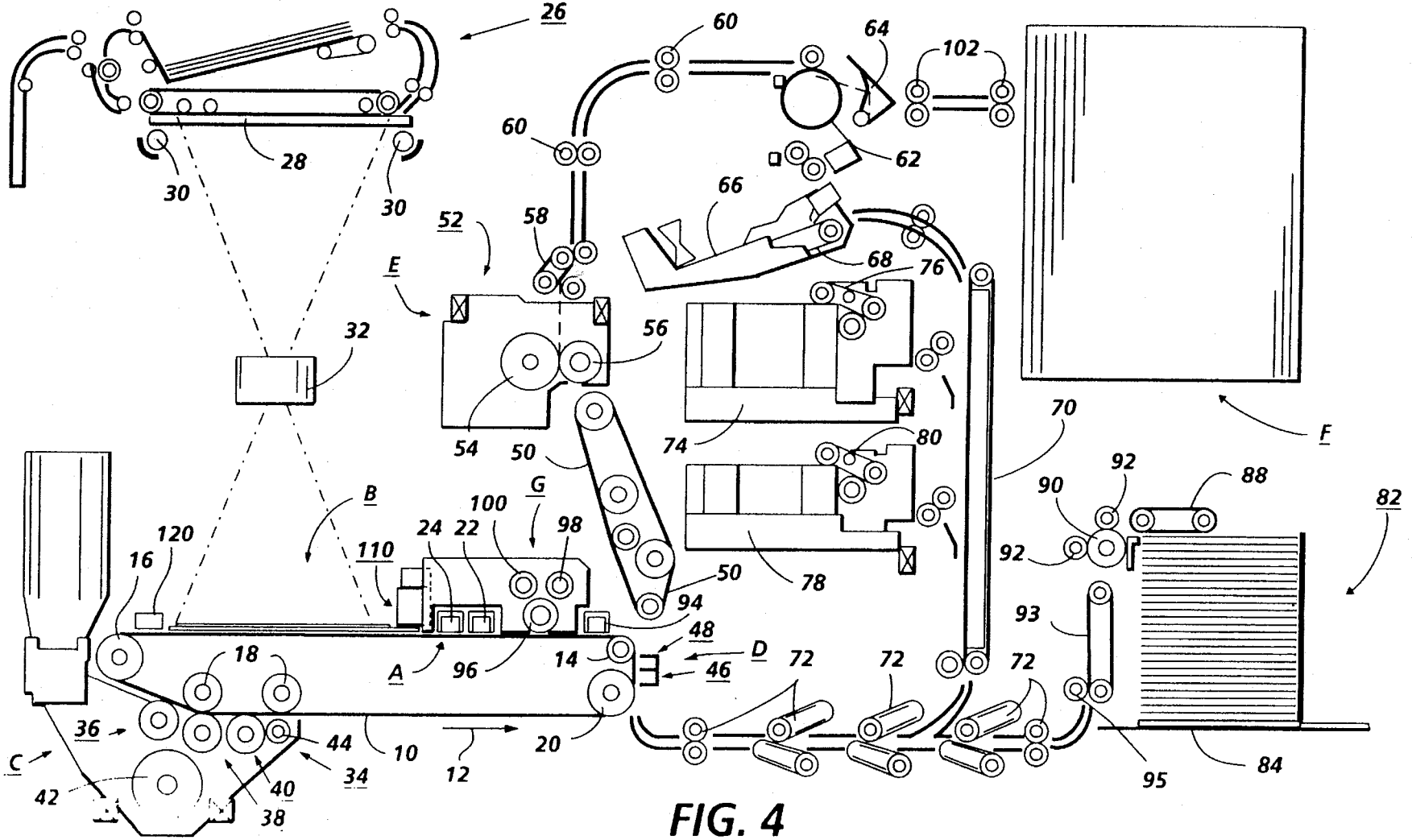

FIG. 3 is a perspective view of an illustrative photoreceptor belt showing a plurality of image areas or "pitches" superimposed thereon with the occluder bar in an operational configuration relative thereto; and FIG. 4 is a schematic elevational view of an illustrative electrophotographic printing machine of the type which could advantageously utilize the annotation system including an occluder bar assembly in accordance with the present invention.

While the present invention will hereinafter be described in connection with a preferred embodiment and process, it will be understood that it is not intended to limit the invention to that embodiment or process. On the contrary, the following description is intended to cover all alternatives, modifications, and equivalents, as may be included within the spirit and scope of the invention as defined by the appended claims. Other aspects and features of the present invention will become apparent as the following description progresses.

For a general understanding of the features of the present invention, reference is made to the drawings, wherein like reference numerals have been used to identify particular elements, components and subsystems. Inasmuch as the art of electrostatographic printing and electrophotographic copying is well known, the various processing stations employed in such processing machines will initially be described briefly with reference to FIG. 4. It will become apparent from the following discussion that the occluding device of the present invention is equally well suited for use in a wide variety of electrophotographic or other electronic printing systems. It will be further understood that the present invention is not necessarily limited in its application to the particular embodiment or embodiments shown and described herein.

Turning initially to FIG. 4, prior to discussing the invention in detail, a schematic depiction of an exemplary electrophotographic reproducing machine incorporating various subsystems is furnished wherein a photoconductive belt 10 is employed, preferably comprising a photoconductive material coated on a ground layer, which, in turn, is coated on an anti-curl substrate. The photoconductive material typically includes a transport layer, which may contain molecules of di-m-tolydiphenylbiphenyldiamine dispersed in a polycarbonate, coated on a generator layer, generally made from trigonal selenium. The grounding layer is typically made from a titanium coated Mylar. Of course, other suitable photoconductive materials, ground layers, and anti-curl substrates may also be employed.

Belt 10 is entrained about stripping roller 14, tensioning roller 16, rollers 18, and drive roller 20. Stripping roller 14 and rollers 18 are mounted rotatably so as to rotate with belt 10. Tensioning roller 16 is resiliently urged against belt 10 to maintain belt 10 under a desired tension. Drive roller 20 is rotated by a motor (not shown) coupled thereto by any suitable means such as a drive belt. Thus, the rotational movement of roller 20 advances belt 10 in the direction of arrow 12 to advance successive portions of the photoconductive surface sequentially through the various processing stations disposed about the path of movement thereof.

Initially, a portion of photoconductive belt 10 passes through charging station A whereat two corona generating devices, indicated generally by reference numerals 22 and 24, charge photoconductive belt 10 to a relatively high, substantially uniform potential. This dual or "split" charging system is designed so that corona generating device 22 places all of the required charge on photoconductive belt 10 while corona generating device 24 acts as a leveling device to provide a uniform charge across the surface of the belt. Corona generating device 24 also fills in any areas which may have been missed by corona generating device 22.

Figure 1:
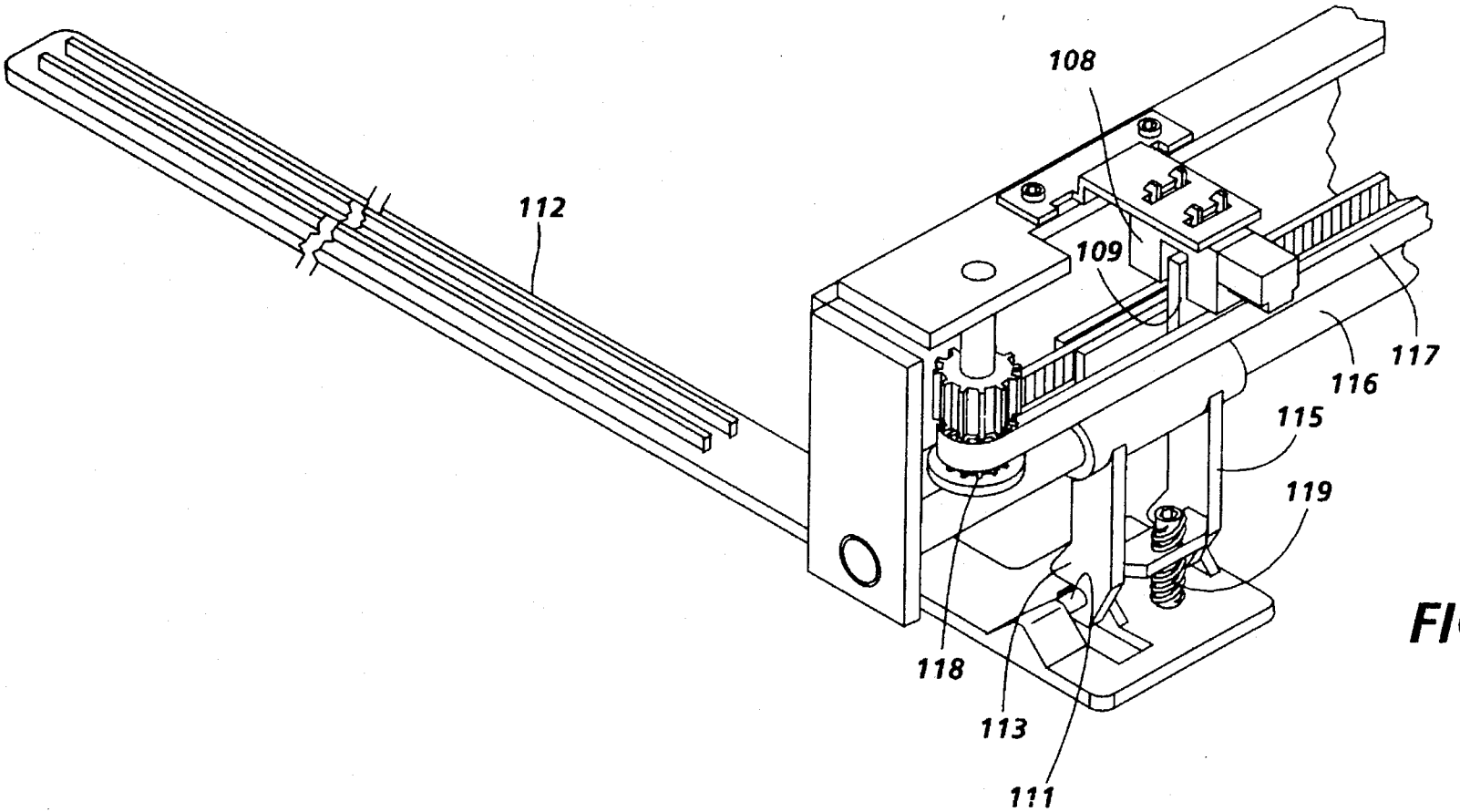
FIG. 1 is a perspective view of the occluder bar assembly of the present invention.
Figure 2:
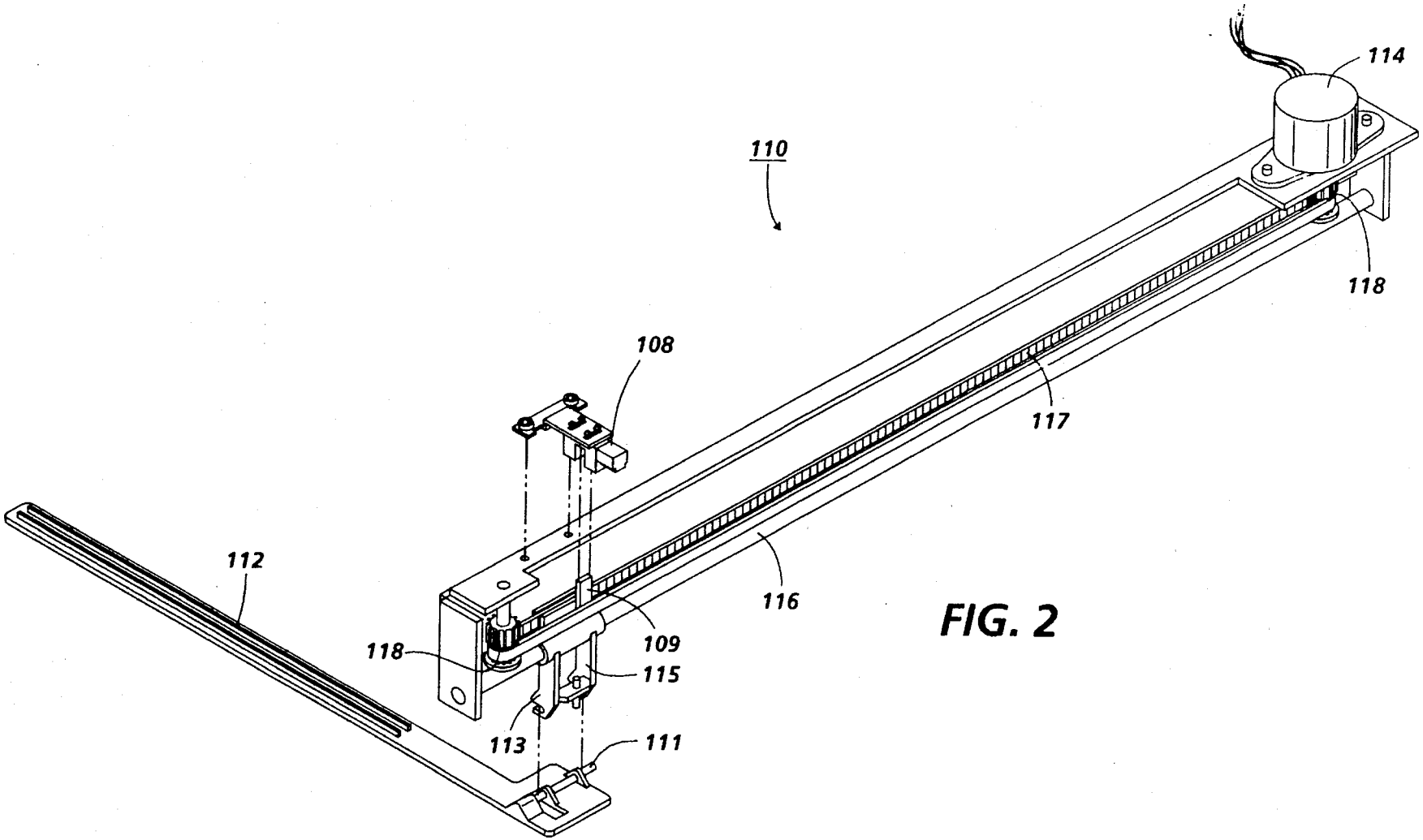
FIG. 2 is an exploded view of the releasable feature of the occluder bar assembly of the present invention.

Next, the charged portion of photoconductive belt 10 is advanced through imaging station B, whereat an original document to be reproduced is placed on platen 28 for being imaged onto the charged photoconductive belt 10. Imaging of the document is achieved by two flash lamps 30 mounted in the optics cavity for illuminating the document on platen 28. Light rays are reflected from the document and transmitted through lens 32 which focuses the light image of the original document onto the charged portion of the photoconductive surface of belt 10 to selectively dissipate the charge thereon. This records an electrostatic latent image on photoconductive belt 10 corresponding to the informational areas contained within the original document. In accordance with the present invention, an annotation system including an occluding device assembly 110 and a light emitting source 120 such as, for example, an LED array is provided, whereby the occluder device mask operates to the photoreceptor in a predetermined area so that the charge on the photoreceptor in that area is not dissipated by the light image of the original document. Subsequently, the light emitting source records a separate, additional image on the photoreceptor. This annotation system, which will be described in greater detail with respect to FIGS. 1–3, is located essentially just in advance of the processing station that applies developing material to the charged image pattern on the photoconductive belt surface 10, the so-called development station, generally indicated by reference letter C.

It is noted that, at imaging station B, a document handling unit, indicated generally by reference numeral 26, may be positioned over platen 28 of the printing machine. The document handling unit 26 sequentially feeds documents from a stack of documents placed in a document stacking and holding tray such that the original documents to be copied are loaded face up into the document tray on top of the document handling unit. Using this system, a document feeder, located below the tray, feeds the bottom document in the stack to a pair of rollers for advancing the document onto platen 28 by means of a belt transport which is lowered onto the platen with the original document being interposed between the platen and the belt transport. When the original document is properly positioned on platen 28, the document is imaged and the original document is returned to the document tray from platen 28 by either of two paths. If a simplex copy is being made or if this is the first pass of a duplex copy, the original document is returned to the document tray via a simplex path. Conversely, if this is the inversion pass of a duplex copy, then the original document is returned to the document tray through a duplex path.

At development station C, a magnetic brush developer housing, indicated generally by the reference numeral 34, is provided, having three developer rolls, indicated generally by the reference numerals 36, 38 and 40. A paddle wheel 42 picks up developer material, generally comprising triboelectrically charged carrier granules and toner particles, in the developer housing 34 for delivering the developer material to the developer rolls. When the developer material reaches rolls 36 and 38, it is magnetically split between the rolls with approximately half of the developer material being delivered to each roll. Photoconductive belt 10 is situated adjacent rolls 36 and 38 for attracting toner particles from an extended development zone formed thereby. Developer roll 40 is a cleanup roll and magnetic roll 44 is a carrier granule removal device adapted to remove any carrier granules adhering to belt 10. Thus, rolls 36 and 38 advance developer material into contact with the electrostatic latent image, which may include the additional image information provided by the annotation system, whereby the latent image attracts toner particles from the carrier granules of the developer material to form a toner powder image on the photoconductive surface of belt 10.

After development, belt 10 then advances the toner powder image to transfer station D, where a sheet of support material or a copy sheet (not shown) is moved into contact with the toner powder image. A corona generating device 46 charges the copy sheet to a proper potential so that the sheet is electrostatically secured or "tacked" to belt 10. Corona generating device 46 also provides electrostatic fields for attracting the toner image from the photoreceptor belt 10 to the copy sheet. Thus, the transfer station operates to induce contact between the developed image on belt 10 and the sheet of support material for transfer of the toner image thereto.

A high capacity feeder, indicated generally by the reference numeral 82, is the primary source of copy sheets, High capacity feeder 82 includes a tray 84 supported on an elevator (not shown). The elevator is driven by a bidirectional motor to move the tray up or down. In the up position, the copy sheets are advanced from the tray to transfer station D. A vacuum feed belt 88 feeds successive uppermost sheets from the stack to a take away roll 90 and rolls 92. The take-away roll 90 and rolls 92 guide the sheet onto transport 93. Transport 93 and roll 95 advance the sheet to rolls 72 which, in turn, move the sheet into the transfer zone at transfer station D.

After the developed image is transferred to the copy sheet, a second corona generator 48 charges the copy sheet to a polarity opposite that provided by corona generator 46 for electrostatically separating or "detacking" the copy sheet from belt 10. Thereafter, the inherent beam strength of the copy sheet causes the sheet to separate from belt 10 onto conveyor 50, positioned to receive the copy sheet for transporting the copy sheet to fusing station E.

Fusing station E includes a fuser assembly, indicated generally by the reference numeral 52, for permanently affixing the transferred toner powder image to the copy sheet. Preferably, fuser assembly 52 includes a heated fuser roller 54 and a pressure roller 56. The developed copy sheet is transported to the fusing station with the powder image on the copy sheet contacting fuser roller 54. The pressure roller 56 abuts the fuser roller 54 to provide the necessary pressure to fix the toner powder image to the copy sheet. In this exemplary fuser assembly, the fuser roll 54 is internally heated by a quartz lamp while a release agent, stored in a reservoir, is pumped to a metering roll which eventually applies the release agent to the fuser roll.

After fusing, the copy sheets are fed through a decurling apparatus 58 which bends the copy sheet in one direction to put a known curl in the copy sheet, thereafter bending the copy sheet in the opposite direction to remove that curl as well as any other curls or wrinkles which may have been introduced into the copy sheet. The copy sheet is then advanced, via forwarding roller pairs 60 to duplex turn roll 62. A duplex solenoid gate 64 selectively guides the copy sheet to finishing station F or to duplex tray 66. In the finishing station, the copy sheets are collected in sets and the copy sheets of each set can be stapled or glued together. Alternatively, a solenoid activated gate 64 can be used to divert the sheet into duplex tray 66, providing intermediate storage for those sheets that have been printed on one side and on which an image will be subsequently printed on the second, opposed side thereof, i.e. the sheets being duplexed. Duplex sheets are typically stacked in duplex tray 66 face down in a configuration, one on top of another, in the order in which they are copied. In order to complete duplex copying, the simplex sheets in tray 66 are fed, in seriatim, by a bottom feeder 68, from tray 66 back to transfer station D, via conveyor 70 and rollers 72. These sheets are then transported back to the transfer station for transfer of a toner powder image to the opposite sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets may also be fed to transfer station D from a secondary tray 74 or an auxiliary tray 78 for providing additional sheet capacity on special types of copy sheets. Each tray includes an elevator driven by a bidirectional AC motor and a controller having the ability to drive the tray up or down. When the tray is in the down position, stacks of copy sheets are loaded thereon or unloaded therefrom. In the up position, successive copy sheets may be dispersed therefrom by a sheet feeder 76 or 80. Sheet feeder 76 or 80 may comprise a friction retard feeder, as shown schematically in FIG. 3, utilizing a feed belt and take-away rolls to advance via rollers 102 successive copy sheets to transport 70 which, in turn, advances the sheets to rolls 72 and then to transfer station D. It will be recognized that secondary tray 74 and auxiliary tray 78 are supplemental sources of copy sheets for providing machine adaptability and flexibility for particular print jobs.

Invariably, after the copy sheet is separated from photoconductive belt 10, some residual particles remain bonded thereto. Thus, after transfer, photoconductive belt 10 passes beneath yet another corona generating device 94 which charges the residual toner particles to the proper polarity for breaking the bond between the toner particles and the belt. Thereafter, a precharge erase lamp (not shown), located inside the loop formed by photoconductive belt 10, discharges the photoconductive belt in preparation for the next charging cycle. Residual particles are removed from the photoconductive surface at cleaning station G which may include an electrically biased cleaner brush 96 and two waste and reclaim de-toning rolls 98 and 100, as illustrated. The reclaim roll 98 may be electrically biased to a polarity opposite that of the cleaner roll 96 so as to remove toner particles therefrom while the waste roll 100 may also be electrically biased positively relative to the reclaim roll 98 so as to remove paper debris and wrong sign toner particles. The toner particles on the reclaim roll 98 are scraped off and deposited in a reclaim auger (not shown), where they are transported out of the rear of cleaning station G.

The various machine functions are regulated by a controller (not shown) which is preferably a programmable microprocessor designed to communicate and manage all of the machine functions hereinbefore described. The controller controls all the printer steps and functions as described herein, including imaging onto the photoreceptor, paper delivery, xerographic functions associated with developing and transferring the developed image onto the paper, various processing functions provided by finishing station F, and operation of the annotation system of the present invention, including the selective positioning of the occluding device 110, as well as control of the light emitting source 120. The printer controller initiates a sequencing schedule which is highly efficient in monitoring the status of a series of successive print jobs which are to be printed and finished in a consecutive fashion. Conventional sheet path sensors or switches may be utilized to keep track of the position of documents and the sheets in the machine. In addition, the controller regulates the various positions of gates and switching mechanisms, depending upon the mode of operation selected. Among other things, the controller may provide time delays, jam indications and fault actuation. Selective operation of all of the exemplary systems described hereinabove may be accomplished by a conventional user interface control having the capability to provide operator input through a console or graphic user interface device.

The foregoing description should be sufficient for the purposes of the present disclosure for patent to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the operation of the present invention.

Referring now to FIG. 3, wherein further details of the annotation system and, in particular, the occluding device assembly of the present invention are shown. A plurality of latent image areas, or so-called pitches 116, are shown in phantom on the surface of the photoreceptor belt 10, wherein each pitch corresponds to an image area produced by imaging station B. A copy sheet, identified by reference numeral 109 is shown entering the input side of the transfer station D, comprising transfer corotron 46 and detack corotron 48 situated in a spaced relationship to photoreceptor belt 10. The copy sheet 109 is engaged in a feed nip comprising a pair of rollers 72 operative to transport the copy sheet 109 to the transfer station through chute 108. The copy sheet is subsequently advanced into contact with photoreceptor belt 10, where it will meet the belt 10 in synchronization with a developed latent image area or pitch thereon.

The annotation system of the present invention is also shown in schematic form in FIG. 3, located essentially just in advance of the development area C at which toner is applied to the charged image pattern on the surface of the photoconductive belt 10. The annotation system includes an occluding device assembly 110, described in greater detail hereinbelow with reference to FIGS. 1 and 2, comprising an occluder bar 112 and a drive motor 114, a light emitting source 120 which preferably takes the from of an LED array, and a programmable control means (not shown), coupled to the annotation system for providing selective control thereof. The occluder bar 112 is designed to pass less than 100% of the light emanating from a strobe bulb of the type used in the electrostatographic printing machine for masking the photoreceptor to define a predetermined region of retained charge thereon.

In operation, the annotation system is actuated as an operator selectable feature via a graphic user interface (not shown) coupled to the previously described controller in the form of a programmable microprocessor. The occluder bar 112 is automatically advanced (via motor 114) to a selected position so as to shield or mask a predetermined region in an image pitch 116 on the belt 10 when the discharge light 30 of the imaging system B of the machine reflects the image producing light pattern from the original document platen 28 onto the belt surface. This masking process prevents the discharge of the belt 10 by the discharge light 30 for creating a charged region on the photoconductive belt 10 in an area normally discharged by imaging system. Typically, this predetermined region corresponds to an area where images from the original document do not appear, such as the top or bottom margin of the document. The occluder bar 112, and the predetermined region of retained charge created thereby, are positioned in alignment with an LED array 120 such that, as the belt surface passes under the LED array 120 a number, letter or alphanumeric character is exposeded to the charged area proscribed by the occluder bar 112. If white on black development is desired, the LED array 120 is illuminated in the image of the character and only the character pattern area is discharged. Thus, toner will be picked-up in the entire predetermined region. Conversely, if black on white is desired the entire predetermined region will be illuminated by the LED matrix except for the character pattern area such that toner will only be picked-up by the character area. In this printing mode, margin LEDs may also be provided and continuously illuminated for erasing the predetermined retained charge area extending beyond the characters produced by LED array 120. As shown in FIG. 3, in a preferred embodiment, the light emitting source 120 may be constructed to include two identical LED arrays aligned with predetermined occluder bar positions corresponding to the bottom margin for eleven inch and fourteen inch documents, respectively. It will be understood that other embodiments may be contemplated, wherein a single light source means may be mounted so as to travel in association with or in correspondence with the occluder bar 112 to various appropriate locations as instructed via the controller, and ultimately by the operator.

Referring now to FIGS. 1 and 2, the particular features of the occluding device assembly 110, and in particular, the releasable occluder bar of the present invention will be described in greater detail. As seen in FIG. 2, the occluding device assembly 110 is comprised of the occluder bar 112, a support carriage 115 on which the occluder bar 112 is mounted, a support shaft 116 to which the support carriage 115 is movably mounted and a linear drive system including D.C. motor 114 and drive belt 117 for advancing the occluder bar 112 to various positions with respect to an image pitch on belt 10. The various positions may include a PARK position to the side of the belt surface (as shown in FIG. 2) for storage of the occluder bar when the annotation system is not utilized, and two locations adjacent to specific areas on the belt surface appropriate for use with 11 inch copy paper and 14 inch copy paper (as shown in phantom in FIG. 3). The D.C. motor 114 is connected to the drive belt 117 via a pair of drive gears 118 situated at opposite ends of the drive belt for allowing the belt to travel along a curvilinear path therebetween. The drive belt, in turn, is coupled to the support carriage 115, for providing linear transport thereto along the length of support shaft 116. As can be seen, the motor is provided with conductors for enabling energization of the D.C. motor in response to a signal from the controller or other input. A position sensor 108 of a type well known in the art is also provided and is arranged to align with a position tab 109 protruding from the support carriage for detecting a "home position" to properly locate the occluder bar 112. As best seen in FIG. 1, the position tab 109 extends into a slot in the position sensor 108 for providing an indication that the support carriage 115, and as a result, the occluder bar 112 is in the PARK position, for example.

Referring now to FIGS. 1 and 2, the particular features of the the releasable occluder bar of the present invention will be described in greater detail. In particular, the occluding device assembly of the present invention is provided with a releasable feature for removing the occluder bar 112 from the linear drive system to provide for simple, tool-free removal of the occluder bar 112 by service personnel in the course of routine service and maintenance operations. To this end, the occluder bar 112 is provided with a pivot pin 111 along the end thereof which mates with the support carriage 115 for providing interlocking engagement with two pairs of molded fingers 113 formed in support carriage 115, each pair of fingers forming a molded "keyhole" shaped snap-in feature for receiving respective portions of the pivot pin 111 of the occluder bar. Thus, by engaging the the pivot pin 111 with the opening formed by the molded fingers 113, and applying a small force in the direction of the keyhole, the pin 111 elastically deforms the respective fingers on the support carriage 115 permitting the occluder bar 112 to be mounted and supported therein such that the pivot pin is captured within each keyhole formed by the respective fingers 113 while allowing a pivoting motion around the pin axis.

In addition to the interlocking pin/finger arrangement described hereinabove, the occluder bar assembly of the present invention is provided with an adjustment means in the form of a hex adjustment screw mounted on the support carriage 115 in alignment with a portion of the occluder bar 112 adjacent the pivot pin 111. This adjustment screw is utilized to restore the occluder bar 112 to a selected position and orientation relative to the surface of the photoreceptor 10 so that a replaced occluder bar can be reinstalled in a machine in the precise position that existed prior to removal thereof. More importantly, the adjustment screw 119 maintains the setting for the attitude of the occluder bar parallel to the photoreceptor even in the absence of the bar so that no further adjustment should be necessary upon replacement of an occluder bar. This feature overcomes limitations in prior art designs which required a tedious and time consuming check or readjustment of the occluder bar 112 any time the shield is disturbed.

The replaceable feature of the present invention solves a number of significant problems encountered in prior art annotation systems. In prior art annotation systems, such as those sold for use in the Xerox Corporation model 1075 and 1090 copier/duplicators, for example, the occluder bar was fixedly mounted to a drive assembly such that the use of tools were required to remove, replace or adjust the occluder bar. This fixed mounting strategy within the congested interior of the machine, coupled with delicate nature of the occluder bar adjacent to the surface of the photoreceptor, made routine service activities very difficult and often resulted in disturbing the occluder bar setup or breakage thereof. The releasable feature of the present invention, however, makes for an occluder bar assembly wherein the occluder bar is readily removable such that damage thereto can be avoided and other routine service activities can be easily facilitated. The occluder bar can be installed onto the drive mechanism without the use of tools, thereby permitting fast and simple removal and decreasing the likelihood of damage to the shield or nearby components. In addition, the incorporation of a set screw adjustment feature inherently restores the shield to the same position and orientation that existed prior to removal without any additional attention, thereby eliminating readjustment of the occluder bar mounting position every time the occluder bar was disturbed or replaced.

It is, therefore, evident that there has been provided, in accordance with the present invention, an electrostatographic copying apparatus that fully satisfies the aspects of the present invention as hereinbefore set forth. While this invention has been described in conjunction with a preferred embodiment and method therefor, it is evident that many alternatives, modifications, and variations will be apparent to those skilled in the art. Accordingly, it is intended to embrace all such alternatives, modifications and variations as fall within the spirit and broad scope of the appended claims.

We claim:

1. An annotation system for automatically recording additional image information on an image bearing member, comprising:

an occluding device assembly, including an occluder bar for masking the image bearing member in a predetermined region to allow for the additional image information to be recorded thereon; and a drive apparatus for selectively positioning said occluder bar with respect to an image area on the image bearing member; and means for releasably mounting said occluder bar to said drive apparatus; and a light emitting source for producing a light image of the additional image information.

2. The annotation system of claim 1, wherein said means for releasably mounting said occluder bar to said drive apparatus includes:

a pivot pin; and at least one pair of molded fingers for receiving said pivot pin to provide interlocking engagement therebetween.

3. The annotation system of claim 1, further including adjustment means for selectively adjusting an attitude position of the occluder bar so as to be parallel to a surface of the image bearing member.

4. The annotation system of claim 1, wherein said drive apparatus includes:

a support shaft extending along an axis along which said occluder bar may be selectively positioned;

a support carriage movably mounted on said support shaft, said support carriage including said means for releasably mounting said occluder bar; and a linear drive system coupled to said support carriage for transporting said support carriage along said support shaft.

5. The annotation system of claim 4, wherein said drive apparatus further includes:

an electric motor for supplying transport motion to the linear drive system;

a drive belt coupled to said support carriage; and a drive gear couple between said electric motor and said drive belt for transferring transport motion therebetween.

6. The annotation system of claim 1, further including a position sensing means for detecting a presence of the occluder bar at a predetermined position.

7. The annotation system of claim 6, wherein said drive apparatus further includes a position tab extending therefrom for cooperation with said position sensing means.

8. The annotation system of claim 1, wherein the additional image information includes alphanumeric characters.

9. The annotation system of claim 1, wherein said light emitting source includes an LED array.

10. An electrostatographic printing machine for reproducing a copy of an original document, the copy including additional image information thereon, comprising:

a photoconductive member;

means for charging at least a portion of said photoconductive member to a substantially uniform potential;

means for selectively illuminating the charged portion of said photoconductive member to selectively discharge the charged portion of said photoconductive member such that an electrostatic latent image corresponding substantially to the original document being reproduced is recorded thereon; and an annotation system for automatically recording additional image information on said photoconductive member, including an occluder bar for masking a region of the charged portion of said photoconductive member normally discharged by said illuminating means to prevent the discharge thereof by said illuminating means;

a drive apparatus for selectively positioning said occluder bar with respect to an image area on the image bearing member;

means for releasably mounting said occluder bar to said drive apparatus; and means for selectively discharging the masked region of the charged portion of said photoconductive member to record an electrostatic latent image thereon corresponding to the additional image information.

11. The electrostatographic printing machine of claim 10, wherein said means for releasably mounting said occluder bar to said drive apparatus includes:

a pivot pin; and at least one pair of molded fingers for receiving said pivot pin to provide interlocking engagement therebetween.

12. The electrostatographic printing machine of claim 10, further including adjustment means for selectively adjusting an attitude position of the occluder bar so as to be parallel to a surface of the photoconductive member.

13. The electrostatographic printing machine of claim 10, wherein said drive apparatus includes:

a support shaft extending along an axis along which said occluder bar may be selectively positioned;

a support carriage movably mounted on said support shaft, said support carriage including said means for releasably mounting said occluder bar; and a linear drive system coupled to said support carriage for transporting said support carriage along said support shaft.

14. The electrostatographic printing machine of claim 13, wherein said drive apparatus further includes:

an electric motor for supplying transport motion to the linear drive system;

a drive belt coupled to said support carriage; and a drive gear couple between said electric motor and said drive belt for transferring transport motion therebetween.

15. The electrostatographic printing machine of claim 10, further including a position sensing means for detecting a presence of the occluder bar at a predetermined position.

16. The electrostatographic printing machine of claim 15, wherein said drive apparatus further includes a position tab extending therefrom for cooperation with said position sensing means.

17. The electrostatographic printing machine of claim 10, wherein the additional image information includes alphanumeric characters.

18. The electrostatographic printing machine of claim 10, wherein said means for selectively discharging the masked region of the charged portion of said photoconductive member to record an electrostatic latent image thereon corresponding to the additional image information includes an LED array.

* * * * *